US009681686B2

(12) United States Patent
Miano

(10) Patent No.: US 9,681,686 B2
(45) Date of Patent: Jun. 20, 2017

(54) SAVE A BUTT CIGARETTE ACCESSORY DEVICE

(71) Applicant: Deano Miano, Bergenfield, NJ (US)

(72) Inventor: Deano Miano, Bergenfield, NJ (US)

( * ) Notice: Subject to any disclaimer, the term of this patent is extended or adjusted under 35 U.S.C. 154(b) by 314 days.

(21) Appl. No.: 14/506,483

(22) Filed: Oct. 3, 2014

(65) Prior Publication Data

US 2015/0096571 A1 Apr. 9, 2015

Related U.S. Application Data

(60) Provisional application No. 61/886,167, filed on Oct. 3, 2013.

(51) Int. Cl.

| | |
|---|---|
| ***A24F 13/26*** | (2006.01) |
| ***A24F 15/18*** | (2006.01) |
| ***A24F 13/20*** | (2006.01) |

(52) U.S. Cl.

CPC ..... *A24F 15/18* (2013.01); *A24F 13/20* (2013.01)

(58) Field of Classification Search

CPC ..... A24F 13/20; A24F 13/24; A24F 13/26; A24F 15/12; A24F 15/18

USPC ..... 206/85–86

See application file for complete search history.

(56) References Cited

U.S. PATENT DOCUMENTS

| | | | | |
|---|---|---|---|---|
| 3,743,136 A * | 7/1973 | Chambers | A24F 15/12 | 206/259 |
| 5,738,117 A * | 4/1998 | Fontaine, Jr. | F23Q 2/32 | 131/249 |
| 2005/0051183 A1* | 3/2005 | Coulthard | A24F 13/18 | 131/256 |
| 2007/0000502 A1* | 1/2007 | Chong | A24F 13/24 | 131/249 |

* cited by examiner

*Primary Examiner* — Michael H Wilson
*Assistant Examiner* — Eric Yaary
(74) *Attorney, Agent, or Firm* — Ruth Eure; Emery L. Tracy

(57) ABSTRACT

The invention provides an accessory for cigarette smokers which provides a portable cigarette accessory device for cutting the end of a partially smoked cigarette and storing the partially smoked cigarette for later enjoyment wherein the device is attachable to a disposable lighter.

8 Claims, 2 Drawing Sheets

SAVE A BUTT CIGARETTE ACCESSORY DEVICE

CLAIM OF PRIORITY

This patent application claims priority under 35 USC 119 (e) (1) from U.S. Provisional Patent Application Ser. No. 61/886,167 filed Oct. 3, 2013, of common inventorship herewith entitled, "Multi-Functional Cigarette Assembly and Associated Use Thereof."

FIELD OF THE INVENTION

This invention pertains to the field of cigarette smoking and smoking accessories, and more specifically to the field of portable storage for a cigarette and lighter, and even more specifically to a portable device for storing a cigarette, means for cutting the end of a cigarette and attachment means for a portable lighter for offering smokers a simple and practical means of preserving half-smoked cigarettes for later enjoyment.

SUMMARY OF THE INVENTION

It is an object of the present invention to provide a device for cutting and storing a partially smoked cigarette for later enjoyment.

It is a further object of the present invention to provide a device for cutting and storing a partially smoked cigarette for later enjoyment including attachment means for a disposable lighter.

BACKGROUND OF THE INVENTION

Cigarettes have been around for many centuries, but it wasn't until the 1800s that they gained their paper wrappers and came to some degree of acceptability. In France, especially with women, smoking cigarettes was considered the height of fashion. Ask any smoker today why they find so much pleasure in a cigarette and it is very likely that a plethora of reasons will be given. Whether inhaling the sweet tobacco calms the nerves during stressful times or simply holding a cylindrical smoke allows one to feel enveloped in an aura of cool, smoking provides much enjoyment to the many who indulge in this habit.

While relishing a good cigarette is a relaxing and meditative way for smokers to unwind, it is often difficult for consumers to leisurely enjoy these items in today's hectic and fast-paced world. With the demands of on-the-go living, smokers frequently have to extinguish half-smoked cigarettes, or leave them burning in an ashtray, to attend to necessary daily tasks. All too often, costly smokes are wasted more than they are enjoyed. In addition, with increasing bans on smoking in public buildings, consumers have to take precious minutes out of their day to sneak outdoors for a quick nicotine fix. With little time to finish the cigarette before needing to head back inside, smokers have no choice but to discard it after only a few puffs. In this manner, smoking becomes an even more expensive habit, as wasted cigarettes need to be constantly replaced.

Accordingly, a need remains for a cigarette accessory in order to overcome at least one prior art shortcoming. The exemplary embodiment(s) satisfy such a need by providing a cigarette cutting and storage system that is convenient and easy to use, lightweight yet durable in design, versatile in its applications, and designed for offering smokers a simple and practical means of preserving half-smoked cigarettes for later enjoyment.

BRIEF DESCRIPTION OF THE DRAWINGS

The novel features believed to be characteristic of the exemplary embodiment(s) are set forth with particularity in the appended claims. The disclosure itself, however, both as to its organization and method of operation, together with further objects and advantages thereof, may best be understood by reference to the following description taken in connection with the accompanying drawings in which:

DETAILED DESCRIPTION OF THE INVENTION

The non-limiting exemplary embodiment(s) will now be described more fully hereinafter with reference to the accompanying drawings, in which a preferred embodiment of the disclosure is shown. Such exemplary embodiment(s) may, however, be embodied in many different forms and should not be construed as limited to the embodiment set forth herein. Rather, these embodiment(s) are provided so that this application will be thorough and complete, and will fully convey the true scope of the disclosure to those skilled in the art.

The below disclosed subject matter is to be considered illustrative, and not restrictive, and any appended claim(s) are intended to cover all such modifications, enhancements, and other embodiment(s) which fall within the true scope of the non-limiting exemplary embodiment(s). Thus, to the maximum extent allowed by law, the scope of the non-limiting exemplary embodiment(s) is to be determined by the broadest permissible interpretation of the claim(s) and their equivalents, and shall not be restricted or limited by the foregoing detailed description.

Figure 2:
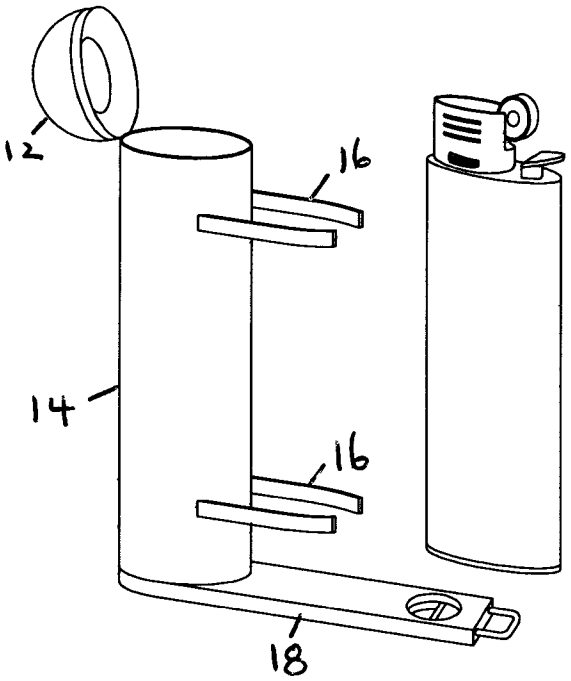
FIG. 2 is a front perspective view showing the cigarette accessory device comprising a cutting and storage system for offering smokers a simple and practical means of preserving half-smoked cigarettes for later enjoyment of the present invention wherein the disposable lighter is not attached to the device.
Figure 1:
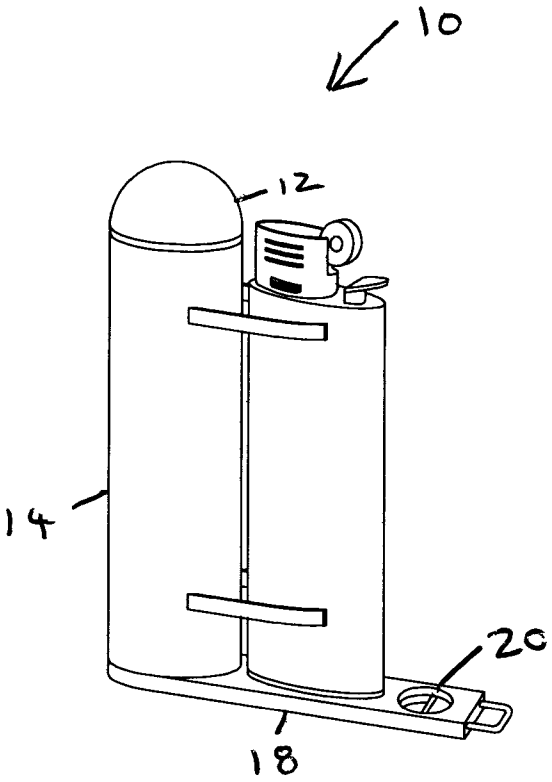
FIG. 1 is a front perspective view showing the cigarette accessory device comprising a cutting and storage system for offering smokers a simple and practical means of preserving half-smoked cigarettes for later enjoyment of the present invention wherein the device is attached to a disposable lighter.

Referring to the figures in general, in a non-limiting exemplary embodiment, a cutting and storage instrument that would easily allow smokers to save unfinished cigarettes for enjoyment at a later time. This product features a size similar to a disposable cigarette lighter; in fact, the cigarette cutting and storage system 10 is conceived to attach to such a flame source so that the product is readily available when needed. Fashioned from a durable material such as stainless steel, for example, the device 10 comprises an essentially cylindrical hollow storage compartment and features an "L" shape. The vertical section of the "L" comprises the cylindrical storage compartment 14 suitable for receiving a cigarette and having a removably attached cap or lid 12. Lid 12 can be a hinged lid, as is shown in FIG. 2. Alternatively, lid 12 can comprise a threaded exterior edge to be received by a mating threaded interior in the cylindrical storage compartment 14. In a further alternative embodiment, lid 12 can comprise a snap friction fit into cylindrical storage compartment 14.

Figure 4:
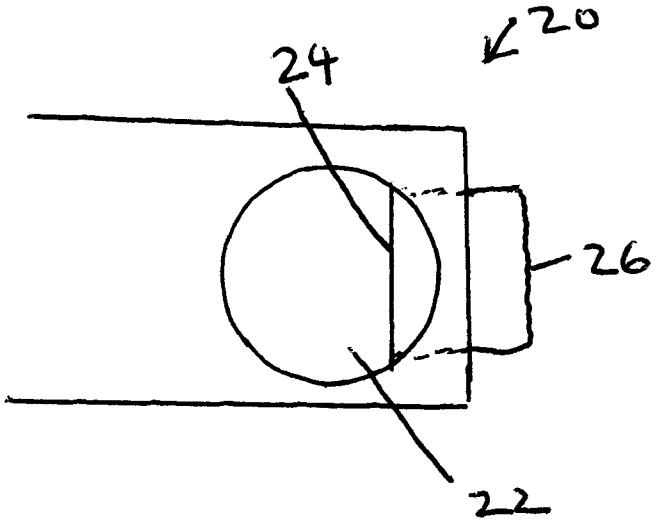
FIG. 4 is a top down close up view of the cutting mechanism of the cigarette accessory device of the present invention comprising a cutting and storage system for offering smokers a simple and practical means of preserving half-smoked cigarettes for later enjoyment.
Figure 3:
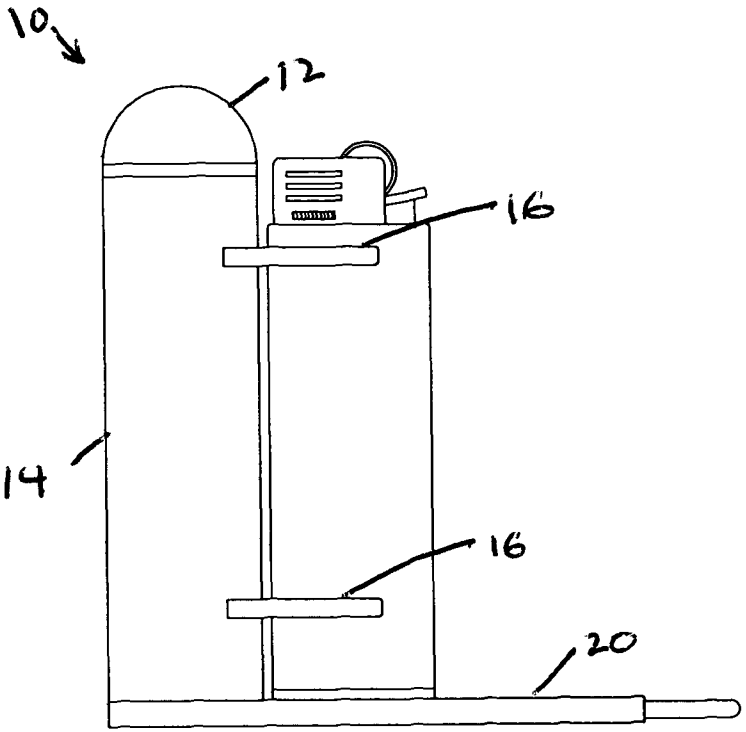
FIG. 3 is a side view showing the cigarette accessory device comprising a cutting and storage system for offering smokers a simple and practical means of preserving half-smoked cigarettes for later enjoyment of the present invention wherein the device is attached to a disposable lighter.

The exterior of the cylindrical storage compartment 14 comprises at least two parallel spaced apart bracket extensions 16 suitable for receiving a disposable lighter. Each bracket extension 16 comprises two mating arms suitable for holding a disposable lighter. A disposable lighter can be snapped onto the device 10 by inserted the lighter into the bracket extensions 16. The foot or horizontal section 18 of the "L" comprises a cutter 20, shown in FIG. 4. Cutter 20 comprises a circular opening 22, across which travels blade 24 which is actuated by pushing in wire tab 26. When tab 26 is pushed into horizontal section 18, blade 24 traverses the opening 22, which can effectively cut off the burnt portion of the end of a cigarette. The cutter 20 operates via a spring mechanism in a manner similar to the cutters used with cigars. Designed to cleanly slice off a portion of the cigarette, this blade removes the burned end of the cigarette from the rest of the unit. Attractive as well as practical, the cigarette cutting and storage system 10 can be offered in a wide variety of appealing colors, from stately solids to more fun and funky pastels, to appeal to individual tastes.

Use and application of the cigarette cutting and storage system 10 would be very simple and straightforward. First, before heading out, the user would attach a unit to his or her cigarette lighter. On a smoke break, the user would simply remove the cigarette, fire it up with the attached lighter, and relish a few drags. To extinguish, the user would insert the burning end of the cigarette into the cutter 20 of the cigarette cutting and storage system. Pushing in tab 26 cuts off the burnt end of the cigarette. Lastly, the half-smoked cigarette is placed into the proximal end of the cylinder and topped with the handy security cap, where it would remain intact and ready to enjoy during the next opportunity to smoke.

There are several significant benefits and advantages associated with this unique product invention. For example, the cigarette cutting and storage system 10 would provide smokers with a simple and effective means of preserving unfinished cigarettes. As smokers are often interrupted during busy days, or are only allowed brief smoke breaks, this practical product would end the common practice of leaving burning cigarettes to smolder away in an ashtray. In addition, users would no longer have to destroy unfinished smokes by vigorously stubbing out the burning end. In this manner, these expensive tobacco products are not wasted, saving the consumer money over time. Configured to cleanly slice away used portions of cigarettes, the cigarette cutting and storage system 10 would keep the units neatly intact between breaks. As such, the cigarette cutting and storage system 10 would also provide a safe means of extinguishing a cigarette, alleviating the risk of setting fires by tossing burning butts into vegetation. Moreover, the clever storage bay would ensure that the remaining cigarette is conveniently stored, freshly preserved, and easily accessible at all times. A clever gift idea, smokers would certainly appreciate receiving this product on gift-giving occasions. Offered in a vast array of colors, there is sure to be a cigarette cutting and storage system 10 to appeal to virtually any smoker, whether male or female.

There has thus been outlined, rather broadly, the more important features of the disclosure in order that the detailed description thereof that follows may be better understood, and in order that the present contribution to the art may be better appreciated.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the disclosure of the application, nor is it intended to be limiting as to the scope of the disclosure in any way.

While the disclosure has been described with respect to certain specific embodiment(s), it will be appreciated that many modifications and changes may be made by those skilled in the art without departing from the spirit of the disclosure. It is intended, therefore, by the description hereinabove to cover all such modifications and changes as fall within the true spirit and scope of the disclosure. In particular, with respect to the above description, it is to be realized that the optimum dimensional relationships for the parts of the exemplary embodiment(s) may include variations in size, materials, shape, form, function and manner of operation.

The invention claimed is:

1. A cigarette cutting and storage device for preserving half-smoked cigarettes for later enjoyment, said cigarette cutting and storage device comprising:

a canister having a top end and a bottom end, the canister suitably sized and shaped for holding at least one cigarette;

a platform having a first end and a second end, the first end of the platform connected to the bottom end of the canister, the platform extending in a general direction away from and substantially perpendicular to the canister;

a cutting mechanism formed in the second end of the platform for cutting a cigarette; and at least two bracket extensions attached to said canister between the top end and the bottom end of the canister, said bracket extensions being suitably sized and shaped for holding a cigarette lighter wherein upon releasbly securing the cigarette lighter within the bracket extensions, the cigarette lighter rests upon the platform between the canister and the cutting mechanism; and wherein the cutting mechanism is positioned beyond the cigarette lighter allowing the cutting mechanism to be used when the cigarette lighter is releasably secured within the bracket extensions.

2. The device of claim 1 wherein the canister has a removably attached cap or lid.

3. The device of claim 1, wherein the cutting mechanism comprises a circular opening, across which travels a blade actuated by pushing into a horizontal section, the blade traverses the opening, which can effectively cut off a burnt portion of a cigarette.

4. The device of claim 2, wherein the lid is hingedly mounted to the top of the cylindrical storage compartment.

5. The device of claim 2, wherein the lid comprises a threaded exterior edge to be received by a mating threaded interior in the cylindrical storage compartment.

6. The device of claim 2, wherein the lid is removably attached to the cylindrical storage compartment by means of a snap friction fit.

7. The device of claim 1 provided in a variety of colors and patterns.

8. The device of claim 1 wherein the two bracket extensions comprise at least two parallel spaced apart mating arms suitable for receiving the disposable lighter.

* * * * *